US011359424B2

(12) United States Patent
Li et al.

(10) Patent No.: US 11,359,424 B2
(45) Date of Patent: Jun. 14, 2022

(54) TOOL BOX

(71) Applicants: Hong-Jen Li, Taichung (TW); Jian-Ying Li, Taichung (TW)

(72) Inventors: Hong-Jen Li, Taichung (TW); Jian-Ying Li, Taichung (TW)

( * ) Notice: Subject to any disclaimer, the term of this patent is extended or adjusted under 35 U.S.C. 154(b) by 363 days.

(21) Appl. No.: 16/540,104

(22) Filed: Aug. 14, 2019

(65) Prior Publication Data

US 2021/0047870 A1 Feb. 18, 2021

(51) Int. Cl.

| | |
|---|---|
| ***E05C 19/06*** | (2006.01) |
| ***E05B 15/16*** | (2006.01) |
| ***B25H 3/00*** | (2006.01) |
| ***B65F 1/16*** | (2006.01) |

(52) U.S. Cl.

CPC ..... *E05C 19/06* (2013.01); *B25H 3/00* (2013.01); *B65F 1/1623* (2013.01); *E05B 15/1635* (2013.01)

(58) Field of Classification Search

CPC ..... E05C 1/10; E05C 19/06; B65F 1/1623; B25H 3/00; B25H 3/02; E05B 39/00; E05B 39/002; E05B 65/523; E05B 15/1635; E05B 17/0037; B65D 21/0217; B65D 21/0215; B65D 43/16; B65D 43/22; B65D 45/15; B65D 45/22; B65D 2211/00

USPC ..... 220/326, 324, 315

See application file for complete search history.

(56) References Cited

U.S. PATENT DOCUMENTS

| | | | | |
|---|---|---|---|---|
| 3,863,996 | A * | 2/1975 | Raimondi | F16C 27/02 384/108 |
| 4,344,646 | A * | 8/1982 | Michel | A45C 13/1084 220/326 |
| 4,363,403 | A * | 12/1982 | Raucci, Jr | E05B 73/0023 206/1.5 |
| 5,158,329 | A * | 10/1992 | Schlack | E05C 19/06 292/87 |
| 5,577,779 | A | 11/1996 | Dangel | |
| 10,053,891 | B1 * | 8/2018 | Williams | E05B 73/00 |
| 2014/0283636 | A1 * | 9/2014 | Frommann | E05C 19/022 74/110 |

FOREIGN PATENT DOCUMENTS

| | | | | |
|---|---|---|---|---|
| CN | 205799447 U | * | 12/2016 | |
| DE | 20205978 U1 | * | 7/2002 | B65D 21/0215 |

(Continued)

*Primary Examiner* — Christine M Mills
*Assistant Examiner* — Peter H Watson
(74) *Attorney, Agent, or Firm* — Alan D. Kamrath; Karin L. Williams; Mayer & Williams PC

(57) ABSTRACT

A tool box includes a first casing, a second casing, at least one fastening member, and at least one first elastic member. The first casing has at least one first receiving slot which has two first restriction portions. The second casing has at least one second receiving slot, a second restriction portion, and a first locking portion. The at least one fastening member has a third restriction portion, a second locking portion, and two fourth restriction portions. The at least one first elastic member is biased between the at least one fastening member and the at least one first receiving slot, and the at least one fastening member is pushed by the at least one first elastic member, such that second locking portion is locked onto the first locking portion to interlock the first casing and the second casing.

18 Claims, 12 Drawing Sheets

(56) References Cited

FOREIGN PATENT DOCUMENTS

| | | | | | |
|---|---|---|---|---|---|
| DE | 102007042972 | A1 * | 6/2008 | ..... | B25H 3/02 |
| EP | 499034 | A2 * | 8/1992 | ..... | E05C 19/06 |
| KR | 200460263 | Y1 * | 11/2011 | ..... | B62J 6/04 |
| KR | 101580623 | B1 * | 7/2015 | ..... | B62J 9/02 |

* cited by examiner

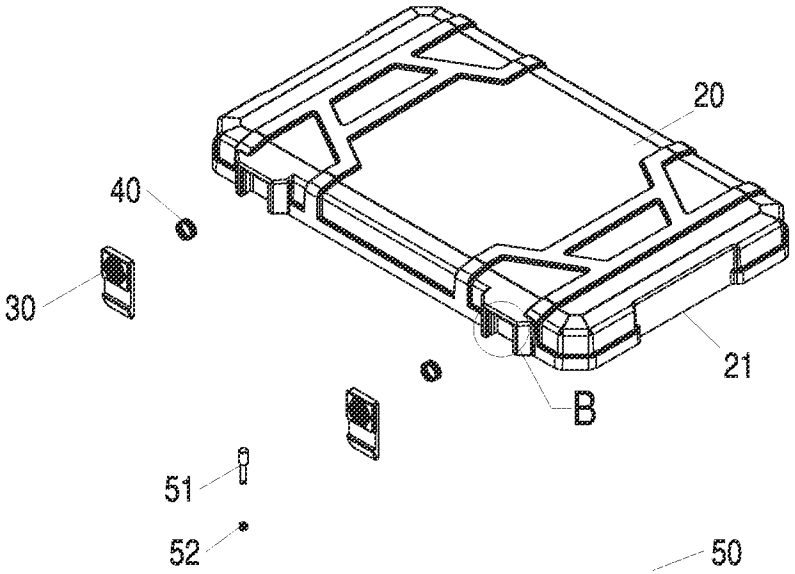
FIG.22
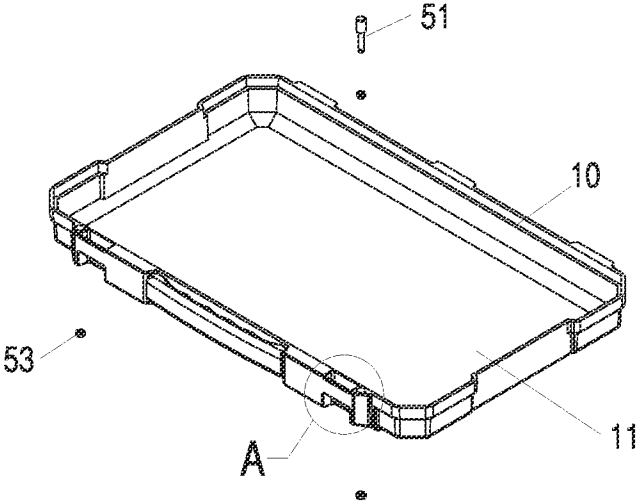
FIG.23
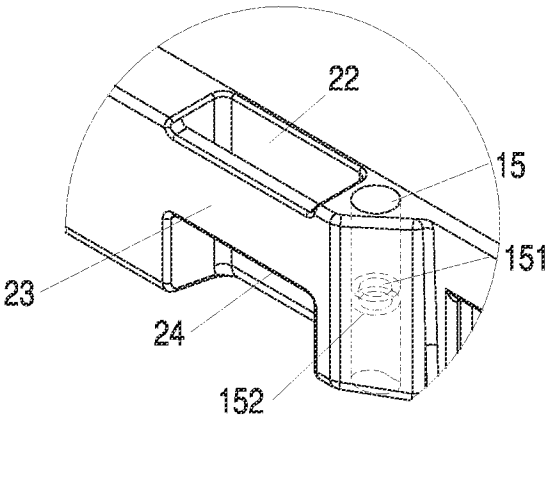
FIG.24
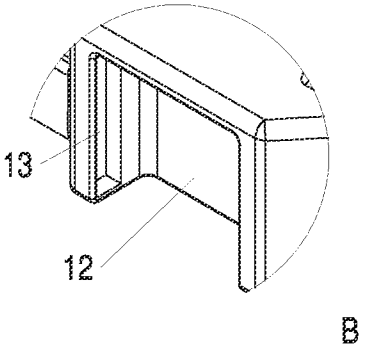

TOOL BOX

BACKGROUND OF THE INVENTION

1. Field of the Invention

The present invention relates to a storage device and, more particularly, to a tool box for storing hand tools.

2. Description of the Related Art

A conventional tool box was disclosed in the U.S. Pat. No. 5,577,779, and comprises a first component 12 which is releasably joined to a second component 16 using a snap fit lock mechanism. A resilient locking arm 10 is integrally molded to first component 12. A pair of support ribs 18 are located between locking arm 10 and first component 12. Locking arm 10 includes a projection 20 integrally molded to the front side of the locking arm. Projection 20 defines a step portion 22. Projection 20 includes a cam surface 21 located between step 22 and the distal end of locking arm 10. A locking frame 14 is integrally molded to second component 16. Locking frame 14 contains a pair of parallel, spaced apart side supports 24, and a crossmember 26 which is attached to the distal end of each side support 24. A resilient tab 28 is integrally molded to second component 16. The snap fit lock mechanism has a released position, shown in FIGS. 1 and 2, and a locked position, shown in FIGS. 5 and 6. In the released position, first component 12 and second component 16 are separated and the lock mechanism is not engaged. In the locked position, first component 12 is joined to second component 16 and the lock mechanism is engaged. When the locking arm 10 is received in the side support 24, the locking arm 10 presses the resilient tab 28, such that the step 22 and the crossmember 26 are locked, and the first component 12 and the second component 16 are interlocked. When the cam surface 21 is pressed, the locking arm 10 is moved to press the resilient tab 28, such that the step 22 is detached from the crossmember 26, and the locking arm 10 is removed from the side support 24, thereby opening the first component 12 and the second component 16. The conventional tool box has the following disadvantage. When the user wishes to detach the step 22 from the crossmember 26, the cam surface 21 is pressed to drive the locking arm 10 to press the resilient tab 28, and the locking arm 10 is moved with support of the support ribs 18. However, the locking arm 10 and the first component 12 are formed integrally, and the resilient tab 28 and the second component 16 are formed integrally, such that the support ribs 18 at the connection of the locking arm 10 and the first component 12 are easily worn out or broken due to frequent actions during a long-term utilization. In addition, the connection of the resilient tab 28 and the second component 16 is also easily worn out or broken due to frequent actions during a long-term utilization.

BRIEF SUMMARY OF THE INVENTION

The primary objective of the present invention is to provide a tool box having a greater longevity.

In accordance with the present invention, there is provided a tool box comprising a first casing, a second casing, at least one fastening member, at least one first elastic member, at least one thrust unit, and at least one burglar-proof member. The first casing has at least one first receiving slot which has two first restriction portions. The second casing has at least one second receiving slot, a second restriction portion, and a first locking portion. The at least one fastening member is mounted and movable in the at least one first receiving slot and the at least one second receiving slot. The at least one fastening member has a third restriction portion, a second locking portion, and two fourth restriction portions. The at least one first elastic member is biased between the at least one fastening member and the at least one first receiving slot. The at least one fastening member is pushed by the at least one first elastic member, such that second locking portion is locked onto the first locking portion, the third restriction portion rests on the second restriction portion, and the first casing and the second casing are interlocked.

According to the primary advantage of the present invention, the at least one fastening member and the at least one first elastic member are two separate elements, such that the at least one fastening member and the at least one first elastic member will not be damaged or produce elastic fatigue during frequent pressing, so as to have a greater lifetime.

According to another advantage of the present invention, the at least one fastening member is pushed by the at least one first elastic member, such that the second locking portion is locked onto the first locking portion exactly, and the first casing and the second casing are interlocked closely by the at least one fastening member.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

FIG. 22 is an exploded perspective view of a tool box in accordance with a second preferred embodiment of the present invention.

FIG. 23 is a locally enlarged view of the tool box taken along mark A as shown in FIG. 22.

FIG. 24 is a locally enlarged view of the tool box taken along mark B as shown in FIG. 22.

DETAILED DESCRIPTION OF THE INVENTION

Figure 1:
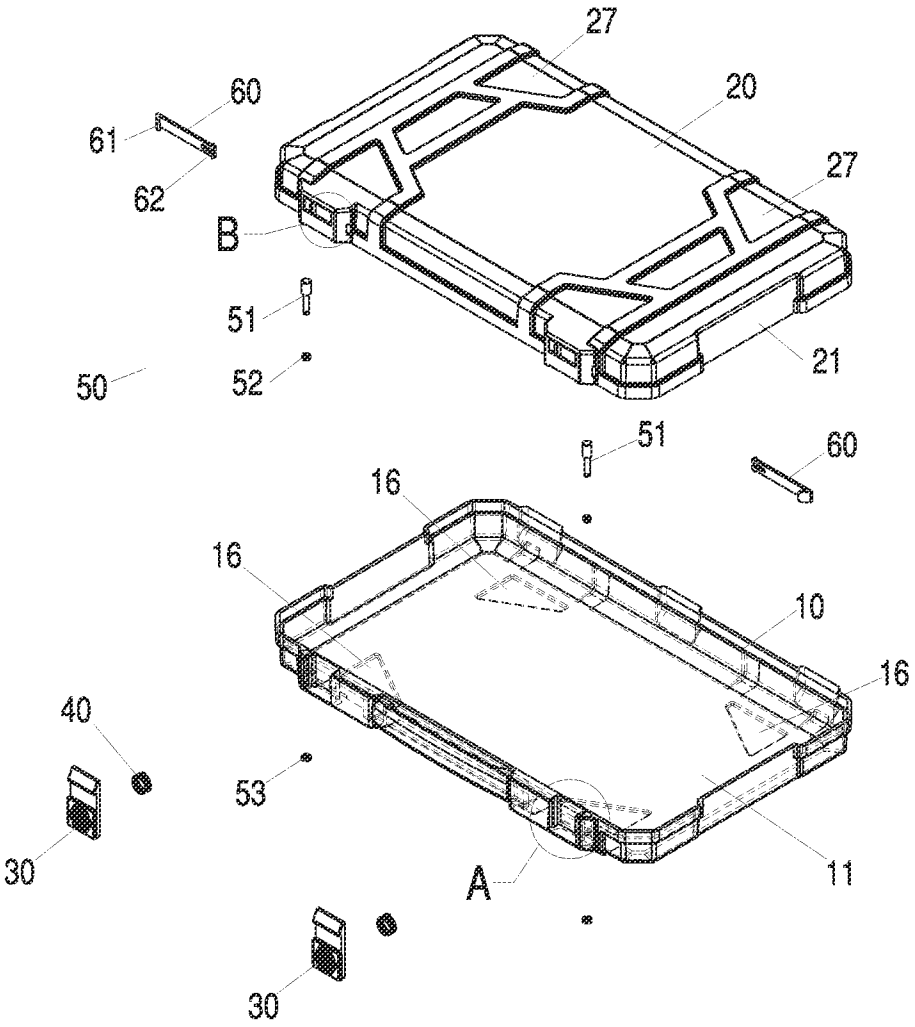
FIG. 1 is an exploded perspective view of a tool box in accordance with the preferred embodiment of the present invention.
Figure 2:
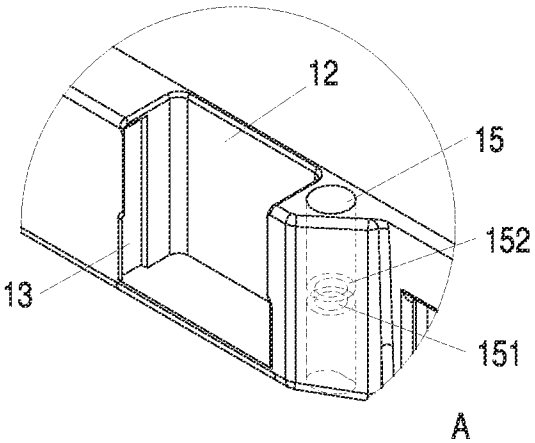
FIG. 2 is a locally enlarged view of the tool box taken along mark A as shown in FIG. 1.
Figure 3:
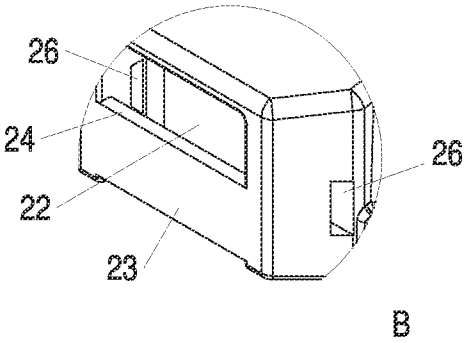
FIG. 3 is a locally enlarged view of the tool box taken along mark B as shown in FIG. 1.
Figure 5:
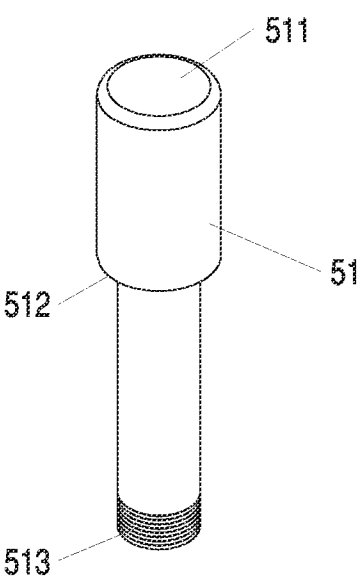
FIG. 5 is a perspective view of a push member of the tool box in accordance with the preferred embodiment of the present invention.
Figure 4:
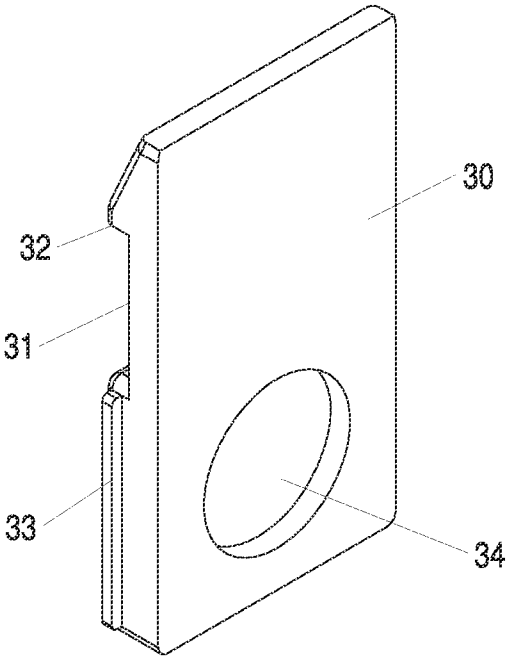
FIG. 4 is a perspective view of a fastening member of the tool box in accordance with the preferred embodiment of the present invention.
Figure 6:
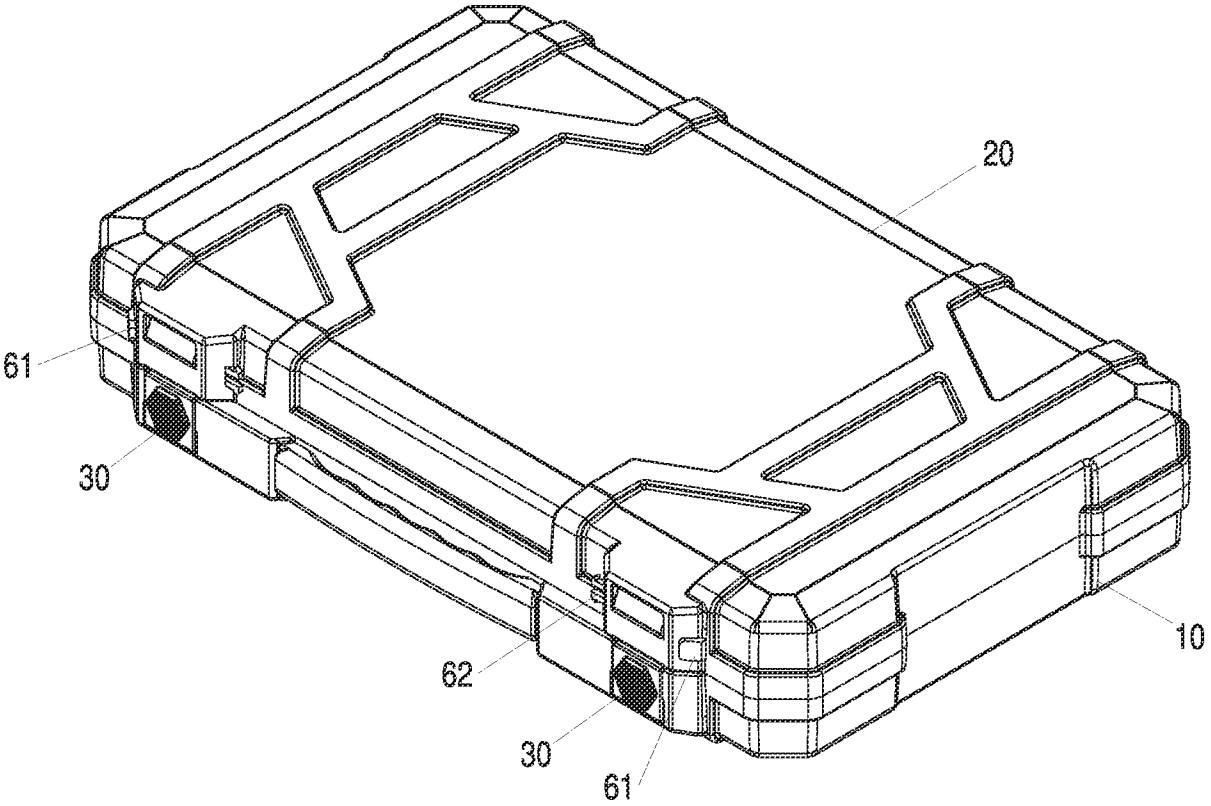
FIG. 6 is a perspective view of the tool box in accordance with the preferred embodiment of the present invention.
Figure 8:
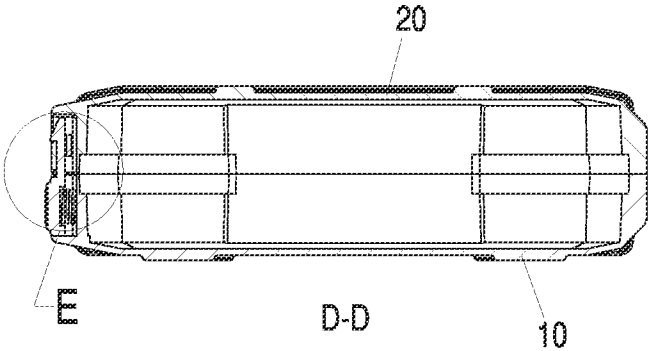
FIG. 8 is a cross-sectional view of the tool box taken along line D-D as shown in FIG. 7.
Figure 7:
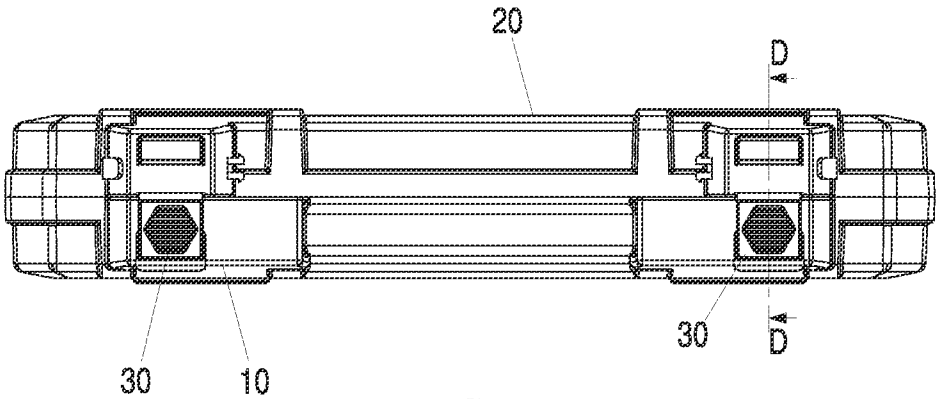
FIG. 7 is a front view of the tool box as shown in FIG. 6.
Figure 9:
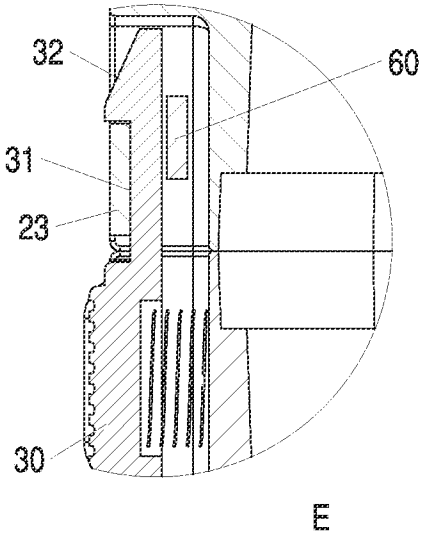
FIG. 9 is a locally enlarged view of the tool box taken along mark E as shown in FIG. 8.
Figure 10:
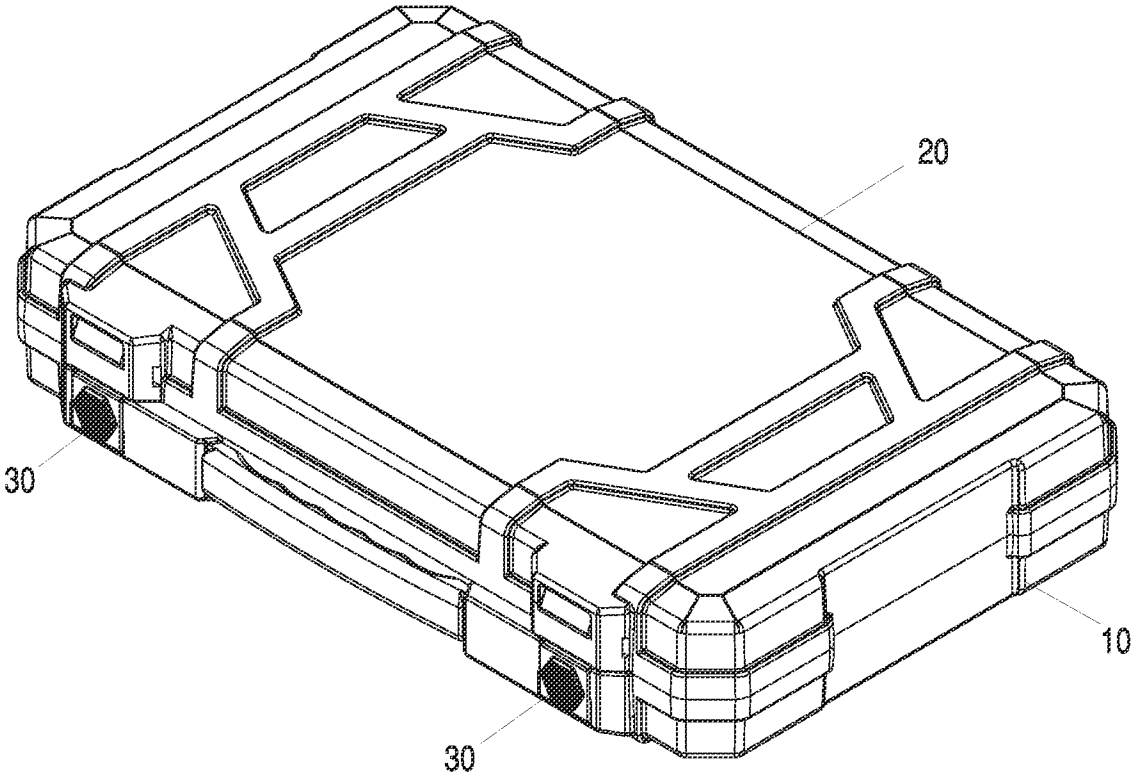
FIG. 10 is a schematic operational view of the tool box as shown in FIG. 1.
Figure 12:
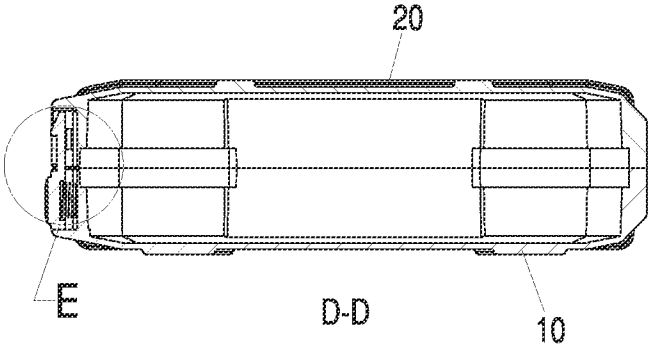
FIG. 12 is a cross-sectional view of the tool box taken along line D-D as shown in FIG. 11.

Referring to the drawings and initially to FIGS. 1-9, a tool box in accordance with the preferred embodiment of the present invention comprises a first casing 10, a second casing 20, at least one fastening (or locking) member 30, at least one first elastic member 40, at least one thrust unit 50, and at least one burglarproof (or antitheft) member 60.

The first casing 10 has a front end face provided with at least one first receiving slot 12. The at least one first receiving slot 12 has two first restriction portions 13 formed on two sides thereof. The two first restriction portions 13 are arranged symmetrically relative to the at least one first receiving slot 12. Each of the two first restriction portions 13 is a rectangular recess. The first casing 10 is provided with at least one first receiving hole 15 located beside and disconnected with the at least one first receiving slot 12. The at least one first receiving hole 15 has a circular shape and penetrates the first casing 10. The at least one first receiving hole 15 is provided with a second receiving hole 151 located at a middle position of the at least one first receiving hole 15. The second receiving hole 151 is smaller than the at least one first receiving hole 15, with a first abutting edge 152 being formed between the second receiving hole 151 and the at least one first receiving hole 15. The second receiving hole 151 has a circular shape and has a diameter smaller than that of the at least one first receiving hole 15. The first casing 10 has a bottom provided with a plurality of first mounting portions 16.

The second casing 20 is assembled with or pivotally connected with the first casing 10. The second casing 20 has a front end face provided with at least one second receiving slot 22 aligning with the at least one first receiving slot 12. The at least one second receiving slot 22 has a front opening provided with a second restriction portion 23. The second restriction portion 23 has a height smaller than that of the at least one second receiving slot 22, such that the front opening of the at least one second receiving slot 22 is partially closed. The second restriction portion 23 is provided with a first locking (or snap-fit) portion 24. The second casing 20 has is provided with at least one passage 26 connected to the at least one second receiving slot 22. The at least one passage 26 transversely penetrates the at least one second receiving slot 22, and has two end openings located at two sides of the at least one second receiving slot 22. The at least one passage 26 has a rectangular shape and has a number corresponding to that of the at least one second receiving slot 22. The second casing 20 has a top provided with a plurality of second mounting portions 27. The second mounting portions 27 of one of multiple tool boxes are mounted on the first mounting portions 16 of another one of the multiple tool boxes, such that the multiple tool boxes are stacked together, without causing displacement therebetween.

The at least one fastening member 30 is mounted and movable forward and backward in the at least one first receiving slot 12 and the at least one second receiving slot 22. The at least one fastening member 30 has a front end face provided with a third restriction portion 31 aligning with the second restriction portion 23. The third restriction portion 31 is provided with a second locking (or snap-fit) portion 32 locked (or snapped) onto the first locking portion 24, such that the first casing 10 and the second casing 20 are interlocked. The at least one fastening member 30 has two fourth restriction portions 33 formed on two sides thereof. The two fourth restriction portions 33 are received in and restricted by the two first restriction portions 13 which prevent the at least one fastening member 30 from being detached from the at least one first receiving slot 12. The two fourth restriction portions 33 are movable forward and backward in the two first restriction portions 13 which limit the maximum displacement distance of the at least one fastening member 30 in the at least one first receiving slot 12 and the at least one second receiving slot 22. Each of the two fourth restriction portions 33 is a rectangular projection.

The at least one first elastic member 40 is biased between the at least one fastening member 30 and a wall of the at least one first receiving slot 12. The at least one fastening member 30 is pushed by the at least one first elastic member 40, such that second locking portion 32 is locked onto the first locking portion 24, the third restriction portion 31 rests on the second restriction portion 23, and the first casing 10 and the second casing 20 are interlocked and cannot be opened.

The at least one thrust unit 50 is mounted in the at least one first receiving hole 15 and rests on the second casing 20. In practice, when the first casing 10 and the second casing 20 are unlocked from the at least one fastening member 30, the second casing 20 is pushed upward by the at least one thrust unit 50. The at least one thrust unit 50 has a number corresponding to that of the at least one first receiving hole 15 and includes a push member 51, a second elastic member 52, and a connecting member 53.

The push member 51 is movable upward and downward in the at least one first receiving hole 15, and has a first end provided with a head 511, and a second end provided with a connecting portion 513. The head 511 has an end portion resting on the second casing 20 and flush with an opening of the at least one first receiving hole 15. The head 511 has a diameter greater than that of the push member 51, with a second abutting edge 512 being formed between the head 511 and the push member 51. The second abutting edge 512 aligns with the first abutting edge 152 and is located between the head 511 and the connecting portion 513.

The second elastic member 52 is mounted on the push member 51, and biased between the first abutting edge 152 and the second abutting edge 512. When the second locking portion 32 is locked onto the first locking portion 24, the first casing 10 and the second casing 20 are closed, and the second elastic member 52 is compressed by the second abutting edge 512.

The connecting member 53 is connected with the connecting portion 513, such that the connecting member 53 and the push member 51 are combined and moved in concert with each other. Thus, the connecting member 53 and the push member 51 are moved synchronously in the at least one first receiving hole 15.

The at least one burglarproof member 60 extends through the at least one passage 26, and rests on a rear end face of the at least one fastening member 30, such that the at least one fastening member 30 is limited by the at least one burglarproof member 60, and cannot be moved in the at least one first receiving slot 12 and the at least one second receiving slot 22. The at least one burglarproof member 60 has a first end provided with a fifth restriction portion 61 resting on an open first end of the at least one passage 26. The at least one burglarproof member 60 has a second end provided with a cuttable portion 62 protruding outward from an open second end of the at least one passage 26. The at least one burglarproof member 60 is limited by the fifth restriction portion 61 and the cuttable portion 62, such that the at least one burglarproof member 60 is not be detached from the at least one passage 26. When the cuttable portion 62 is cut, the at least one burglarproof member 60 is detached from the at least one passage 26, such that the at least one fastening member 30 is released from the at least one burglarproof member 60, and is movable in the at least one first receiving slot 12 and the at least one second receiving slot 22.

In the preferred embodiment of the present invention, the first casing 10 is a lower part of the tool box. The first casing 10 has a rectangular shape and has an interior provided with a first receiving space 11 for receiving hand tools. The second casing 20 is an upper part of the tool box. The second casing 20 has a rectangular shape and has an interior provided with a second receiving space 21 juxtaposed to the first receiving space 11.

In the preferred embodiment of the present invention, the at least one first receiving slot 12 is open, and has a tetragonal shape. When the first casing 10 is provided with a first receiving slot 12, the first receiving slot 12 is located at a middle position of the front end face of the first casing 10, and when the first casing 10 is provided with two first receiving slots 12, the two first receiving slots 12 are located at two sides of the front end face of the first casing 10. The at least one second receiving slot 22 has a tetragonal shape and has a number corresponding to that of the at least one first receiving slot 12. The second casing 20 is provided with two second receiving slots 22. The at least one fastening member 30 has a number corresponding to that of the at least one first receiving slot 12 and that of the at least one second receiving slot 22. The tool box comprises two fastening members 30, two first elastic members 40, and two thrust units 50.

In the preferred embodiment of the present invention, the connecting portion 513 has an external thread, and the connecting member 53 has an internal thread.

In the preferred embodiment of the present invention, the first mounting portions 16 are arranged symmetrically at four corners of the first casing 10. Each of the first mounting portions 16 is a triangular piece. The second mounting portions 27 are arranged symmetrically at four corners of the second casing 20. Each of the second mounting portions 27 is a depression.

In the preferred embodiment of the present invention, the second restriction portion 23 is a rectangular piece.

In the preferred embodiment of the present invention, the at least one burglarproof member 60 has a number corresponding to that of the at least one passage 26. The tool box comprises two burglarproof members 60.

In the preferred embodiment of the present invention, the rear end face of the at least one fastening member 30 is provided with a receiving groove 34, and the at least one first elastic member 40 is received between the at least one first receiving slot 12 and the receiving groove 34.

Figure 13:
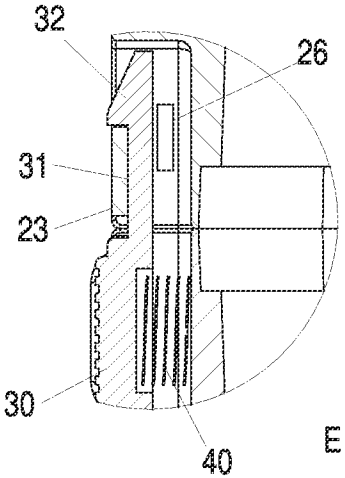
FIG. 13 is a locally enlarged view of the tool box taken along mark E as shown in FIG. 12.
Figure 11:
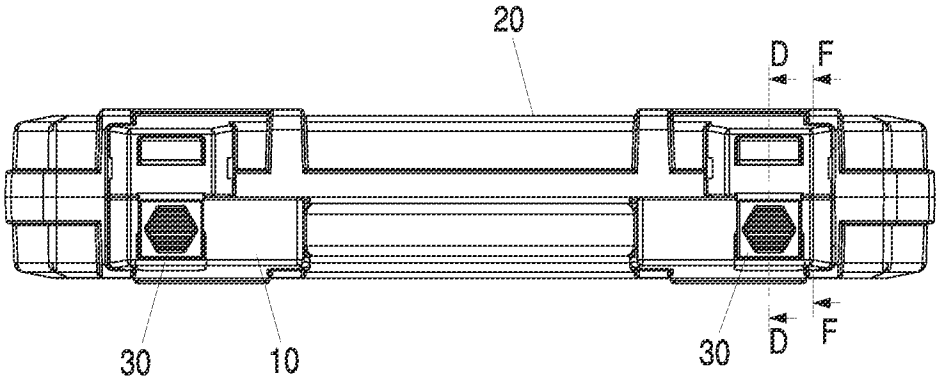
FIG. 11 is a front view of the tool box as shown in FIG. 10.
Figure 14:
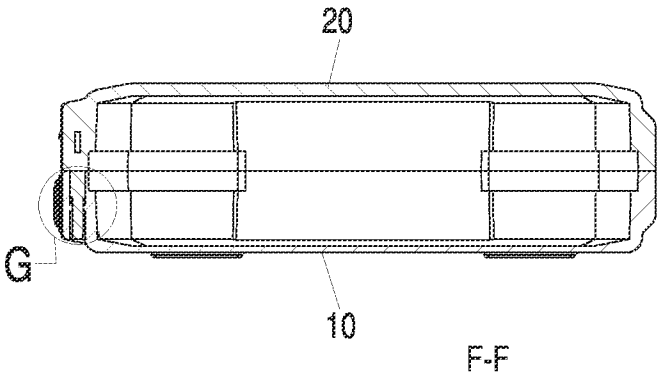
FIG. 14 is a cross-sectional view of the tool box taken along line F-F as shown in FIG. 11.
Figure 15:
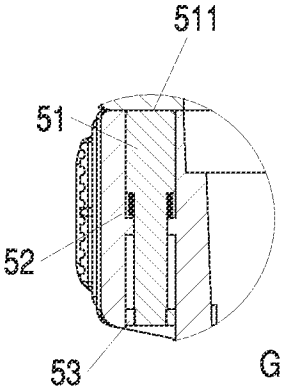
FIG. 15 is a locally enlarged view of the tool box taken along mark G as shown in FIG. 14.

In operation, referring to FIGS. 10-15 with reference to FIGS. 1-9, the head 511 rests on the second casing 20, and the second elastic member 52 is biased between the first abutting edge 152 and the second abutting edge 512, and the connecting member 53 is screwed onto the connecting portion 513. Thus, when the first casing 10 and the second casing 20 are interlocked, the head 511 is pressed by the second casing 20, and the second elastic member 52 is compressed by the second abutting edge 512 as shown in FIG. 15. When the cuttable portion 62 is cut, the at least one burglarproof member 60 is detached from the at least one passage 26 of the second casing 20, such that the at least one fastening member 30 is released from the at least one burglarproof member 60, and is movable in the at least one first receiving slot 12 and the at least one second receiving slot 22 as shown in FIG. 13. At this time, the second locking portion 32 is locked onto the first locking portion 24, such that the first casing 10 and the second casing 20 are interlocked by the at least one fastening member 30.

Figure 16:
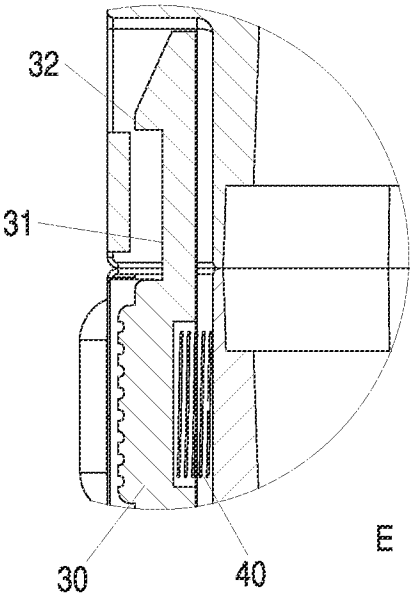
FIG. 16 is a schematic operational view of the tool box as shown in FIG. 13.
Figure 17:
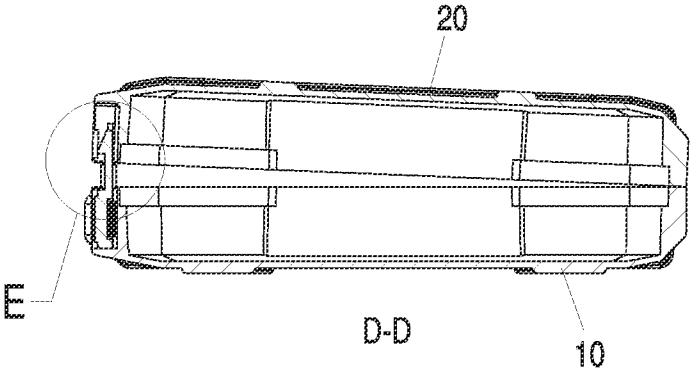
FIG. 17 is a cross-sectional view of another operation state of the tool box taken along line D-D as shown in FIG. 11.

Referring to FIG. 16 with reference to FIGS. 1-15, when the at least one fastening member 30 is pressed, the at least one fastening member 30 is moved backward in the at least one first receiving slot 12 and the at least one second receiving slot 22, the at least one first elastic member 40 is compressed by the at least one fastening member 30, and the second locking portion 32 is detached from the first locking portion 24, such that the first casing 10 and the second casing 20 are unlocked from the at least one fastening member 30, and can be opened.

Figure 19:
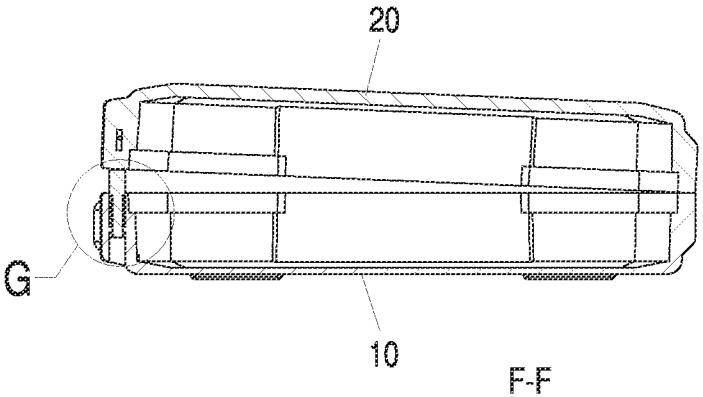
FIG. 19 is a cross-sectional view of another operation state of the tool box taken along line F-F as shown in FIG. 11.
Figure 18:
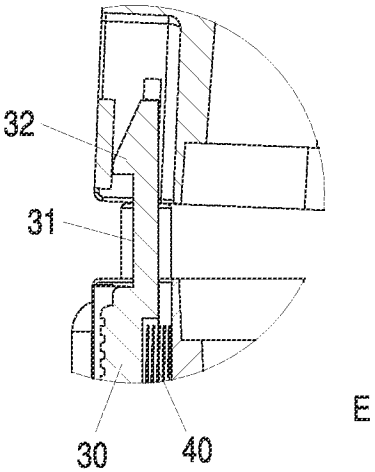
FIG. 18 is a locally enlarged view of the tool box taken along mark E as shown in FIG. 17.
Figure 20:
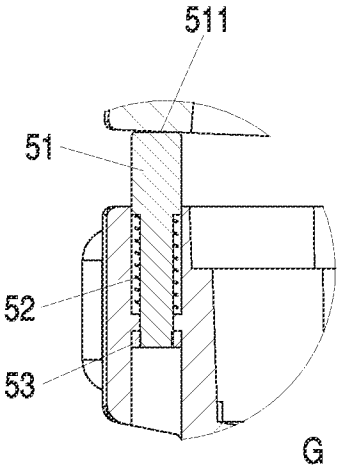
FIG. 20 is a locally enlarged view of the tool box taken along mark G as shown in FIG. 19.

Referring to FIGS. 17-20 with reference to FIGS. 1-16, after the second locking portion 32 is detached from the first locking portion 24 as shown in FIG. 18, the first casing 10 and the second casing 20 are unlocked from the at least one fastening member 30, and the head 511 is pushed upward by the restoring force of the second elastic member 52 to push and move the second casing 20 upward as shown in FIG. 20, such that the second casing 20 is moved outward relative to the first casing 10 as shown in FIG. 19. Thus, the first casing 10 and the second casing 20 are opened.

Figure 21:
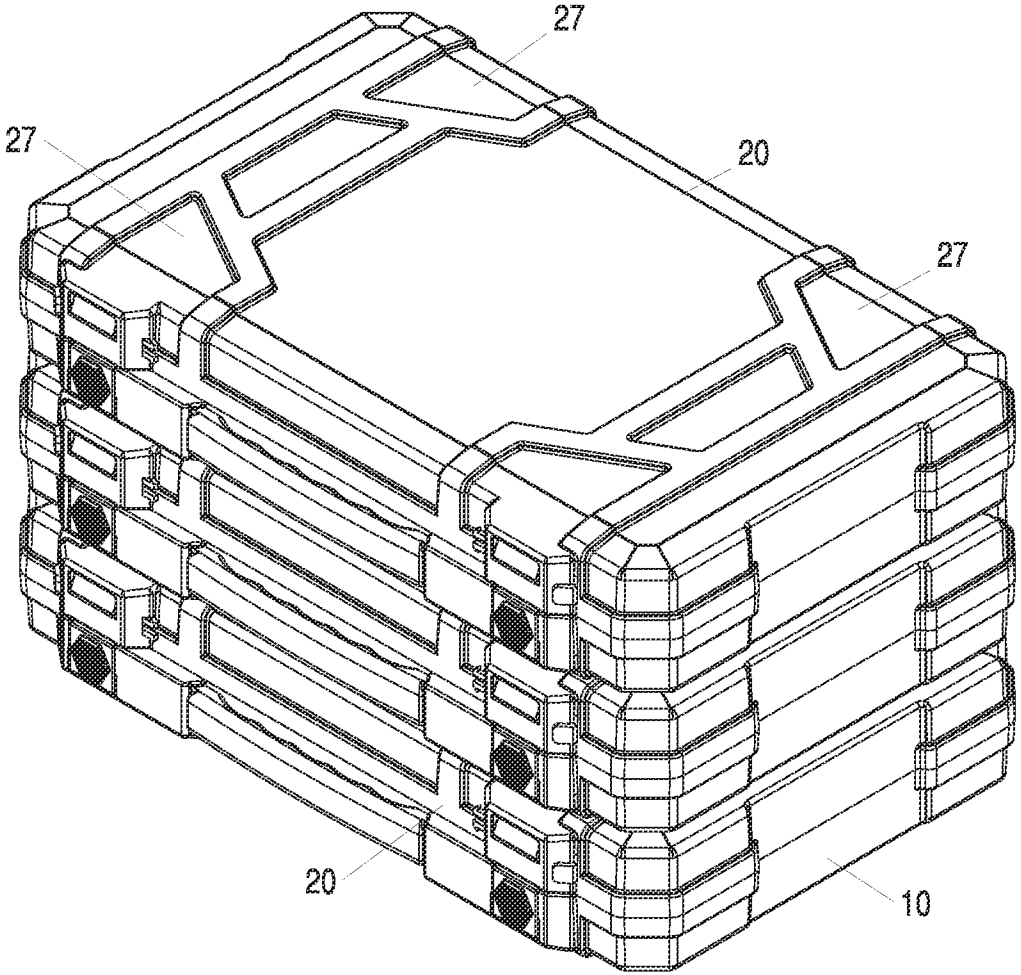
FIG. 21 is a perspective view showing multiple tool boxes are stacked.
Figure 25:
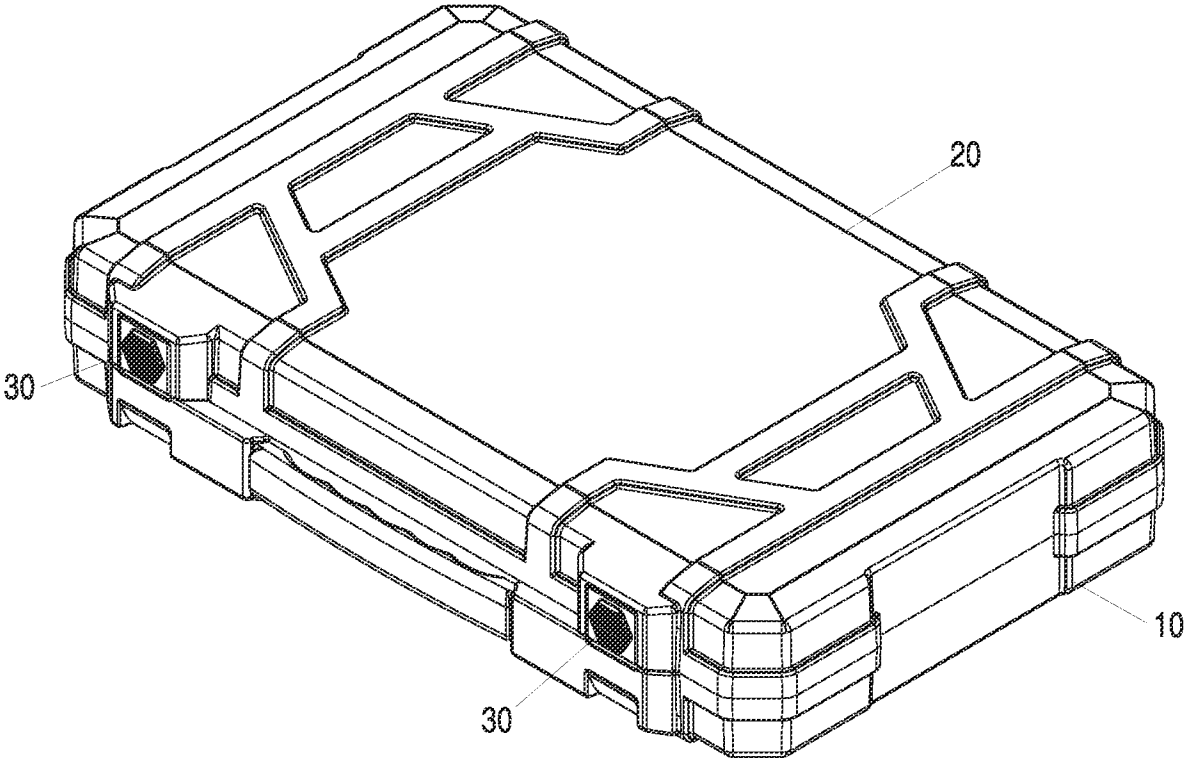
FIG. 25 is a perspective assembly view of the tool box as shown in FIG. 22.

Referring to FIG. 21 with reference to FIGS. 1-9, the second mounting portions 27 of one of multiple tool boxes are mounted on the first mounting portions 16 of another one of the multiple tool boxes, such that the multiple tool boxes are stacked together, without causing displacement therebetween.

Referring to FIGS. 22-25 with reference to FIGS. 1-9, the at least one second receiving slot 22, the second restriction portion 23, and the first locking portion 24 are provided on the first casing 10, the at least one first receiving slot 12 and the two first restriction portions 13 are provided on the second casing 20, and the at least one fastening member 30 is arranged reversely.

Figure 26:
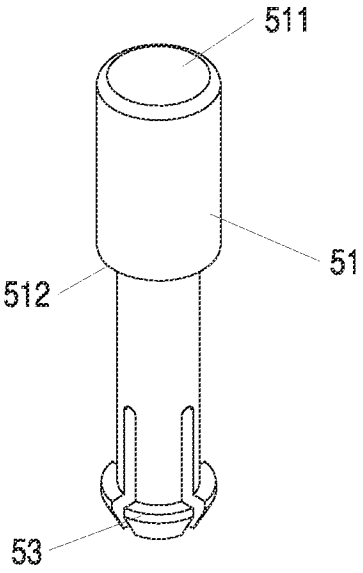
FIG. 26 is a perspective view of a push member of the tool box in accordance with a third preferred embodiment of the present invention.

Referring to FIG. 26, the connecting portion 513 and the connecting member 53 are formed integrally.

In another preferred embodiment of the present invention, the at least one first receiving slot 12, the two first restriction portions 13, the at least one first receiving hole 15, the second receiving hole 151, and the first abutting edge 152 are integrated into a single element which is assembled in the first casing 10, and the at least one second receiving slot 22, the second restriction portion 23, the first locking portion 24, and the at least one passage 26 are integrated into a single element which is assembled in the second casing 20.

Accordingly, the tool box has the following advantages.

1. The at least one fastening member 30 and the at least one first elastic member 40 are two separate elements, such that the at least one fastening member 30 and the at least one first elastic member 40 will not be damaged or produce elastic fatigue during frequent pressing, so as to have a greater lifetime.

2. The at least one fastening member 30 is pushed by the at least one first elastic member 40, such that the second locking portion 32 is locked onto the first locking portion 24 exactly, and the first casing 10 and the second casing 20 are interlocked closely by the at least one fastening member 30.

3. The two fourth restriction portions 33 are moved in and limited by the two first restriction portions 13, and the two first restriction portions 13 limit the maximum displacement distance of the at least one fastening member 30 in the at least one first receiving slot 12, such that the at least one fastening member 30 will not be detached from the at least one first receiving slot 12.

4. The second casing 20 is pushed upward by the at least one thrust unit 50 and is spaced from the first casing 10 after the second casing 20 is unlocked from the at least one fastening member 30, thereby facilitating the user's finger entering the gap between the second casing 20 and the first casing 10, so as to open the tool box.

5. The second mounting portions 27 of one of multiple tool boxes are mounted on the first mounting portions 16 of another one of the multiple tool boxes, such that the multiple tool boxes are stacked together.

6. The at least one burglarproof member 60 rests on the rear end face of the at least one fastening member 30, such that the at least one fastening member 30 is limited by the at least one burglarproof member 60, and cannot be moved in the at least one first receiving slot 12 and the at least one second receiving slot 22, to prevent the second casing 20 and the first casing 10 from being opened, thereby achieving a burglarproof effect.

7. When the cuttable portion 62 is cut, the at least one burglarproof member 60 is detached from the at least one passage 26 of the second casing 20, such that the at least one fastening member 30 is released from the at least one burglarproof member 60, and is movable backward in the at least one first receiving slot 12 and the at least one second receiving slot 22 by pressing the at least one fastening member 30.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A tool box comprising:

a first casing, a second casing, at least one fastening member, at least one first elastic member, at least one thrust unit, and at least one burglarproof member;

wherein:

the first casing has a front end face provided with at least one first receiving slot;

the at least one first receiving slot has two first restriction portions;

each of the two first restriction portions is a rectangular recess;

the first casing is provided with at least one first receiving hole;

the at least one first receiving hole is provided with a second receiving hole;

the second receiving hole is smaller than the at least one first receiving hole, with a first abutting edge being formed between the second receiving hole and the at least one first receiving hole;

the first casing has a bottom provided with a plurality of first mounting portions;

the second casing has a front end face provided with at least one second receiving slot aligning with the at least one first receiving slot;

the at least one second receiving slot has a front opening provided with a second restriction portion;

the second restriction portion has a height smaller than that of the at least one second receiving slot, such that the front opening of the at least one second receiving slot is partially closed;

the second restriction portion is provided with a first locking portion;

the second casing is provided with at least one passage connected to the at least one second receiving slot;

the at least one passage transversely penetrates the at least one second receiving slot, and has two end openings located at two sides of the at least one second receiving slot;

the at least one passage has a rectangular shape and has a number corresponding to that of the at least one second receiving slot;

the second casing has a top provided with a plurality of second mounting portions;

the second mounting portions of one of multiple tool boxes are respectively aligned with and mounted on the first mounting portions of another one of the multiple tool boxes, such that the multiple tool boxes are stacked together;

the at least one fastening member is mounted and movable in the at least one first receiving slot and the at least one second receiving slot;

the at least one fastening member has a front end face provided with a third restriction portion aligning with the second restriction portion;

the third restriction portion is provided with a second locking portion locked onto the first locking portion, such that the first casing and the second casing are interlocked;

the at least one fastening member has two fourth restriction portions formed on two sides thereof;

the two fourth restriction portions are received in and restricted by the two first restriction portions;

the two fourth restriction portions are movable in the two first restriction portions which limit a maximum displacement distance of the at least one fastening member in the at least one first receiving slot and the at least one second receiving slot;

each of the two fourth restriction portions is a rectangular projection;

the at least one first elastic member is biased between the at least one fastening member and a wall of the at least one first receiving slot;

the at least one fastening member is pushed by the at least one first elastic member, such that second locking portion is locked onto the first locking portion, the third restriction portion rests on the second restriction portion, and the first casing and the second casing are interlocked;

the at least one thrust unit is mounted in the at least one first receiving hole and rests on the second casing;

the at least one thrust unit has a number corresponding to that of the at least one first receiving hole and includes a push member, a second elastic member, and a connecting member;

the push member is movable in the at least one first receiving hole, and has a first end provided with a head, and a second end provided with a connecting portion;

the head has an end portion resting on the second casing and flush with an opening of the at least one first receiving hole;

the head has a diameter greater than that of the push member, with a second abutting edge being formed between the head and the push member;

the second abutting edge aligns with the first abutting edge and is located between the head and the connecting portion;

the second elastic member is mounted on the push member, and biased between the first abutting edge and the second abutting edge;

when the second locking portion is locked onto the first locking portion, the second elastic member is compressed by the second abutting edge;

the connecting member is connected with the connecting portion, such that the connecting member and the push member are moved synchronously in the at least one first receiving hole;

the at least one burglarproof member extends through the at least one passage, and rests on a rear end face of the at least one fastening member, such that the at least one fastening member is limited by the at least one burglarproof member, and is not moved in the at least one first receiving slot and the at least one second receiving slot;

the at least one burglarproof member has a first end provided with a fifth restriction portion protruding from and resting on an open first end of the at least one passage;

the at least one burglarproof member has a second end provided with a cuttable portion protruding outward from an open second end of the at least one passage;

the at least one burglarproof member is limited in the at least one passage by the fifth restriction portion and the cuttable portion, and is not detached from the at least one passage; and when the cuttable portion is cut, the at least one burglarproof member is detached from the at least one passage, such that the at least one fastening member is released from the at least one burglarproof member, and is movable in the at least one first receiving slot and the at least one second receiving slot.

2. The tool box of claim 1, wherein:

the first casing is a lower part of the tool box;

the first casing has a rectangular shape and has an interior provided with a first receiving space;

the second casing is an upper part of the tool box; and the second casing has a rectangular shape and has an interior provided with a second receiving space juxtaposed to the first receiving space.

3. The tool box of claim 1, wherein:

the at least one first receiving slot is open, and has a tetragonal shape;

when the first casing is provided with a first receiving slot, the first receiving slot is located at a middle position of the front end face of the first casing;

when the first casing is provided with two first receiving slots, the two first receiving slots are located at two sides of the front end face of the first casing;

the at least one second receiving slot has a tetragonal shape and has a number corresponding to that of the at least one first receiving slot;

the second casing is provided with two second receiving slots;

the at least one fastening member has a number corresponding to that of the at least one first receiving slot and that of the at least one second receiving slot; and the tool box comprises two fastening members, two first elastic members, and two thrust units.

4. The tool box of claim 1, wherein the connecting portion has an external thread, and the connecting member has an internal thread screwed onto the external thread of the connecting portion.

5. The tool box of claim 1, wherein the connecting portion and the connecting member are formed integrally.

6. The tool box of claim 1, wherein:

the first mounting portions are arranged symmetrically at four corners of the first casing;

each of the first mounting portions is a triangular piece;

the second mounting portions are arranged symmetrically at four corners of the second casing; and each of the second mounting portions is a depression allowing insertion of each of the first mounting portions.

7. The tool box of claim 1, wherein the second restriction portion is a rectangular piece.

8. The tool box of claim 1, wherein the at least one burglarproof member has a number corresponding to that of the at least one passage, and the tool box comprises two burglarproof members.

9. The tool box of claim 1, wherein the rear end face of the at least one fastening member is provided with a receiving groove, and the at least one first elastic member is received between the at least one first receiving slot and the receiving groove.

10. The tool box of claim 1, wherein:

the at least one second receiving slot, the second restriction portion, and the first locking portion are provided on the first casing;

the at least one first receiving slot and the two first restriction portions are provided on the second casing; and the at least one fastening member is arranged reversely.

11. The tool box of claim 1, wherein:

the at least one first receiving slot, the two first restriction portions, the at least one first receiving hole, the second receiving hole, and the first abutting edge are integrated into a single element which is assembled in the first casing; and the at least one second receiving slot, the second restriction portion, the first locking portion, and the at least one passage are integrated into a single element which is assembled in the second casing.

12. The tool box of claim 1, wherein the first casing is integrally formed with the at least one first receiving hole, the second receiving hole, and the first abutting edge.

13. The tool box of claim 1, wherein the second receiving hole is connected with the at least one first receiving hole.

14. The tool box of claim 1, wherein the second receiving hole is located at a middle position of the at least one first receiving hole.

15. The tool box of claim 1, wherein the first abutting edge is located at a middle position of the at least one first receiving hole.

16. The tool box of claim 1, wherein the push member extends through the second receiving hole constantly and is not detached from the second receiving hole.

17. The tool box of claim 1, wherein the connecting member is kept in the at least one first receiving hole constantly and is not detached from the at least one first receiving hole.

18. The tool box of claim 1, wherein the at least one burglarproof member is located in the at least one passage, and is non-movable freely relative to the at least one fastening member.

* * * * *